US006485395B1

(12) United States Patent
Stearns et al.

(10) Patent No.: US 6,485,395 B1
(45) Date of Patent: Nov. 26, 2002

(54) BI-MODAL HANDLES FOR EXERCISE APPARATUS

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 53 days.

(21) Appl. No.: 09/604,333

(22) Filed: Jun. 27, 2000

Related U.S. Application Data

(60) Provisional application No. 60/140,943, filed on Jun. 28, 1999.

(51) Int. Cl.[7] ..... A63B 22/00
(52) U.S. Cl. ..... 482/57; 482/52
(58) Field of Search ..... 482/51, 52, 57, 482/70, 79, 80, 62, 72–73

(56) References Cited

U.S. PATENT DOCUMENTS 4,409,742 A * 10/1983 Hohman et al. ..... 34/168
4,509,742 A * 4/1985 Cones ..... 482/57
4,796,881 A * 1/1989 Watterson ..... 482/72
4,902,001 A * 2/1990 Balbo ..... 482/62
5,611,758 A * 3/1997 Rodgers, Jr. ..... 482/51
5,876,307 A * 3/1999 Stearns et al. ..... 482/51
5,938,570 A * 8/1999 Maresh ..... 482/57
6,152,859 A * 11/2000 Stearns ..... 482/52

* cited by examiner

*Primary Examiner*—Stephen R. Crow

(57) ABSTRACT

An exercise apparatus includes left and right arm driven members pivotally mounted on a frame. In a first mode of operation, the arm driven members are free to move in opposite directions relative to one another. In a second mode of operation, the arm driven members are constrained to move in a common direction relative to the frame. Leg driven members may be movably mounted on the frame and linked to the arm driven members.

7 Claims, 15 Drawing Sheets

5010
5012
5000
5057
5002
5058

5010
5012

BI-MODAL HANDLES FOR EXERCISE APPARATUS

CROSS-REFERRENCE TO THE RELATED APPLICATION

Disclosed herein is subject matter that is entitled to the filing date of U.S. Provisional Ser. No. 60/140,943, which was filed Jun. 28, 1999.

FIELD OF THE INVENTION

The present invention relates to exercise methods and apparatus and more particularly, to unique arm exercise assemblies which are suitable for use on various types of exercise equipment.

BACKGROUND OF THE INVENTION

Despite many advances in the field of exercise equipment, room for improvement remains with respect to arm exercise arrangements and/or total body exercise machines.

SUMMARY OF THE INVENTION

The present invention provides unique methods and apparatus for operating left and right arm driven members or handles on an exercise machine. In a first mode of operation, the handles are movable in opposite directions relative to one another, and in a second mode of operation, the handles are constrained to move in a common direction.

On a preferred embodiment of the present invention, the handles are pivotally mounted on a frame, and left and right leg driven members are movably mounted on the frame. The handles are linked to the leg driven members on the preferred embodiment, but may be operated independently on some of the alternative embodiments. Additional features and/or advantages will become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
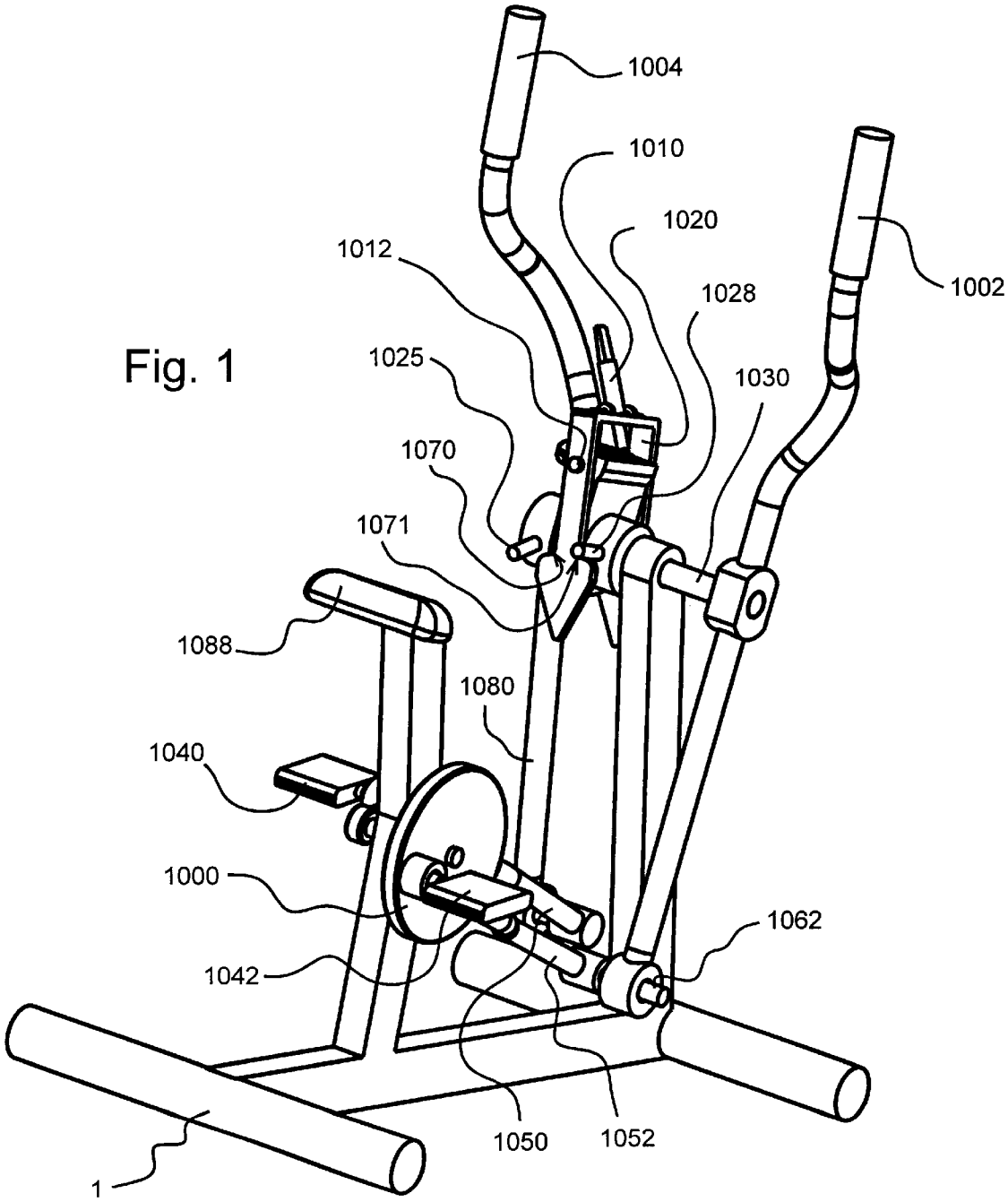
FIG. 1 is a perspective view of a first exercise apparatus constructed according to the principles of the present invention.
Figure 2:
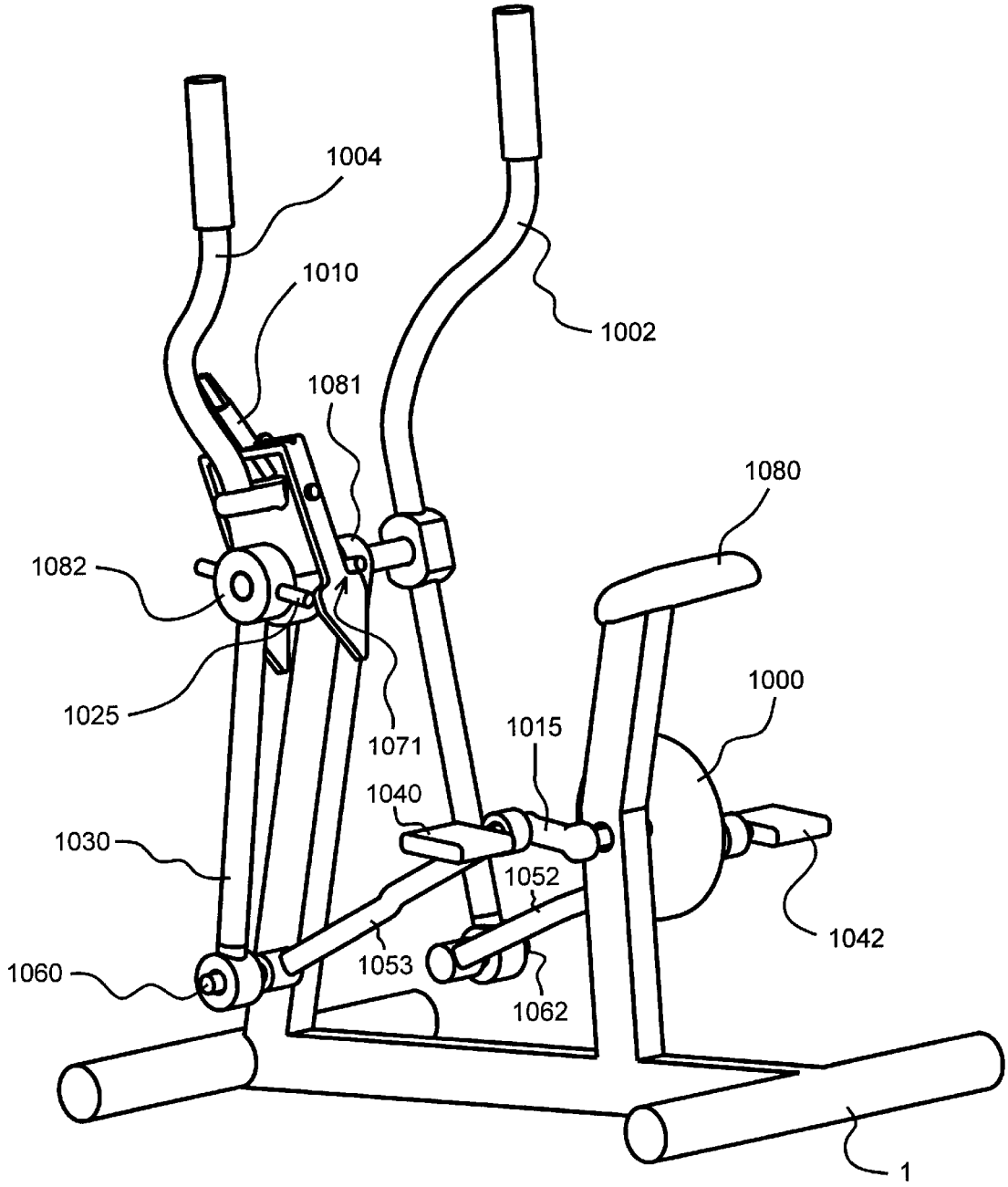
FIG. 2 is another perspective view of the exercise apparatus shown in FIG. 1.
Figure 3:
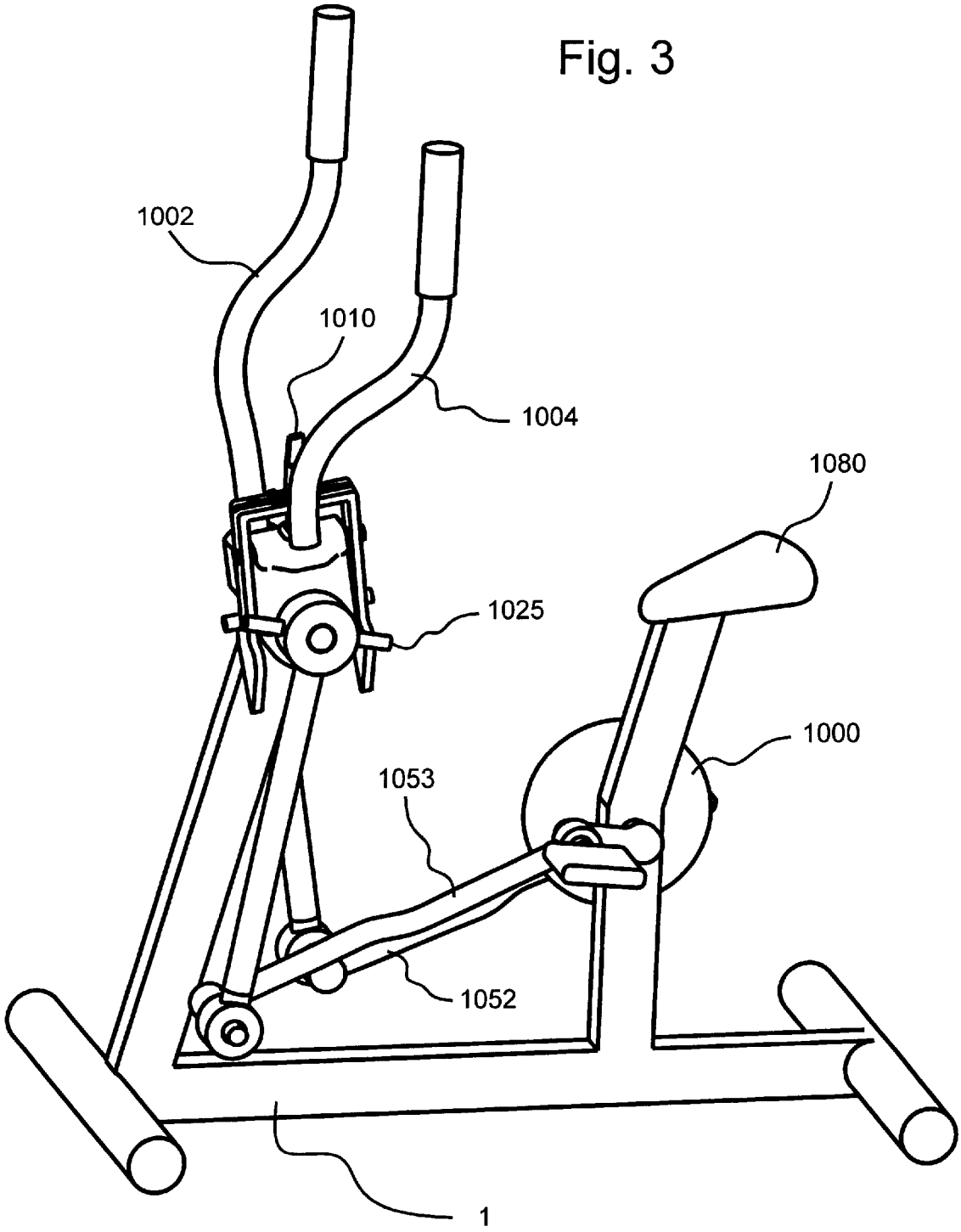
FIG. 3 is yet another perspective view of the exercise apparatus shown in FIG. 1.

FIGS. 1–3 and 12–14 show a mechanism which allows the user to experience opposite reciprocation motion at the hand grips, or unison reciprocating motion wherein both hand grips move the same direction at the same instant. This embodiment is configured for an upright stationary bike, wherein a crank 1000 is rotatably secured to the machine frame, and foot pedals 1042 and 1040 move in a circular path. Right handle bar 1002 is contiguous from the hand grip at an upper distal end, to pin 1062 at a lower distal end. Right connector member 1052 and left connector member 1053 connect right handle bar 1062 and left rocker 1080 to respective right and left pedal cranks, respectively. The upper end of the left rocker terminates at left rocker drive journal 1082, wherein left journal drive pin 1025 is rigid with left rocker 1080. Right rocker drive hub 1081 is rigid with right rocker shaft 1030, and also with right handle bar 1002. Right drive pin 1028 is therefore rigid with right handle bar 1002. Pawl yoke 1020 is rotatably secured to left handle bar 1004 at pawl shaft 1012. Shift peg 1010 is rotatably secured to pawl yoke 1020 at shift peg pivot shaft 1060 (shown best in FIG. 5*b* and FIG. 13). Continuing with FIGS. 1–3, right rockers shaft 1030 is rotatably secured to the machine frame 1, and left rocker drive journal 1082 is rotatably connected and concentric with right rocker shaft 1030. Shift peg 1010 is spring loaded and telescopic between shift peg pivot shaft 1060 and shift peg point 1061 (shown in FIG. 13) such that the operator may toggle (rotate) the shift peg about the shift peg pivot shaft 1060 regardless of the position of pawl yoke 1020. A trough 1063 (FIG. 13) is provided in order to limit the range (or provide a stop) through which the shift peg is allowed to travel. Referring to FIG. 1, the upper portion of the shift peg 1010 has been flipped to the left, whereby the compressed spring contained within the telescopic shift peg 1010 has biased the pawl yoke 1020 counter clockwise as viewed from the rear of the machine. Upon this action, left pawl arcuate seat 1070 has disengaged left journal drive pin 1025, and right pawl arcuate seat 1071 has engaged right drive pin 1028. Because right drive pin 1028 diametrically protrudes in a generally fore and aft direction from the circumferential surface of right rocker drive hub 1081, and because pawl yoke encompasses the right rocker drive hub 1081 (and because pawl yoke also engages the portion of the right drive pin 1028 which protrudes beyond the fore section of right rocker drive hub 1081), the left handle bar 1004 becomes rigidly connected to the right handle bar 1002. FIGS. 2 and 3 show different perspective angles of the mechanism as orientated in FIG. 1. As mentioned previously with reference to FIGS. 1–3, the handle bars are set to operate in a reciprocating unison mode, and with the orientation of the elements shown, the shift peg 1010 may now be flipped to the operator's right side while the left handle bar 1004 remains stationary, whereafter the pawl yoke 1020 may or may not toggle clockwise in preparation for the right and left handle bars to move in an opposite reciprocating manner. If the pawl yoke has not toggled due to tangential forces present at the right pawl arcuate seat 1071, then slight forces exerted at the left or right hand grip will readily cause the pawl yoke 1020 to toggle in anticipation for opposite reciprocating handle bar action.

Figure 4:
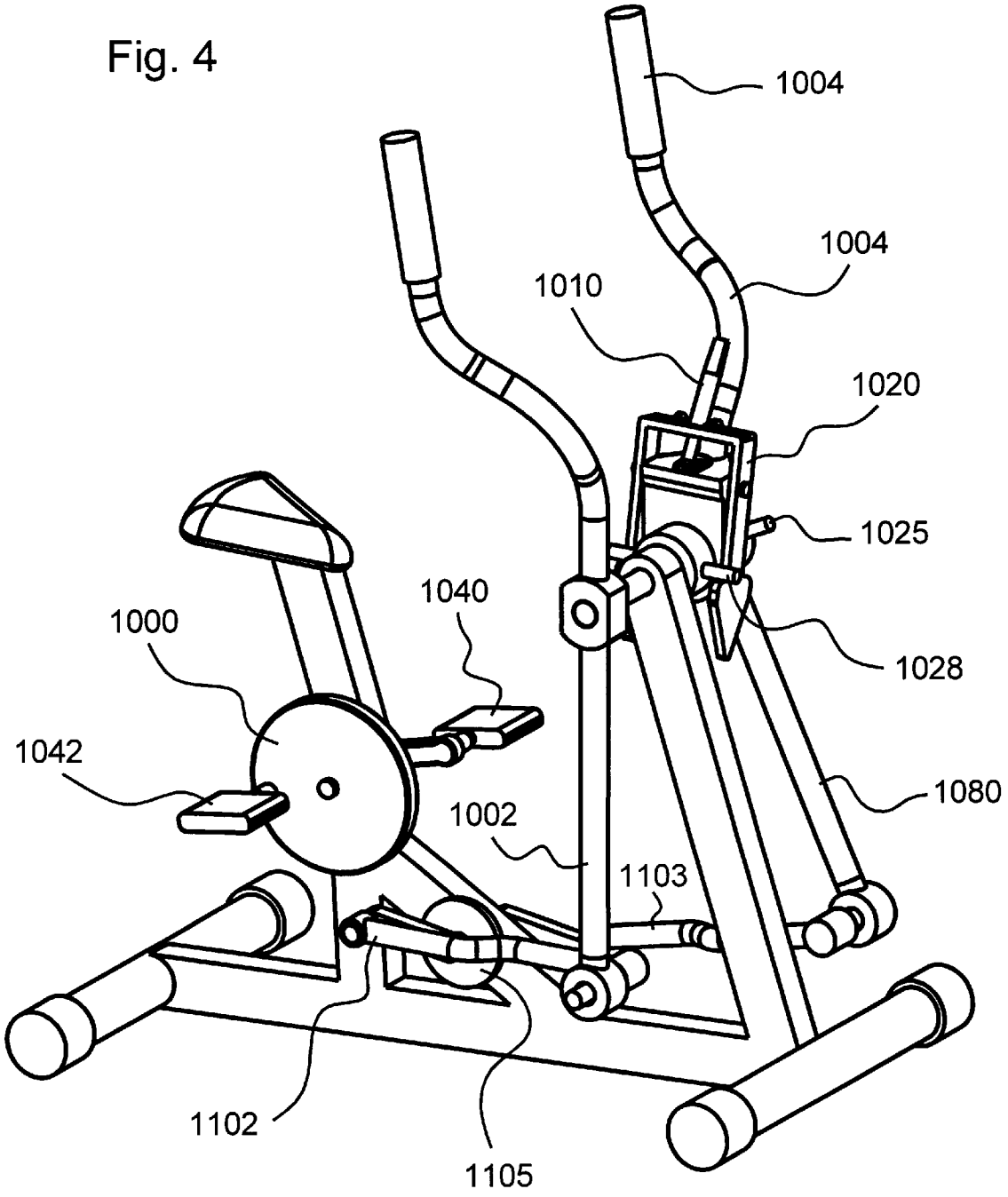
FIG. 4 is a perspective view of a second exercise apparatus constructed according to the principles of the present invention.

FIG. 4 shows an embodiment wherein the handle bars may be cycled in unison or in opposite reciprocating motion independently from the pedal crank. Arm crank 1105 is rotatably secured to the machine frame, and establishes a right crank journal and a left crank journal radially displaced from the crank axis. Right connector 1102 and left connector 1103 are rotatably connected to the right and left crank journals, respectively, and maintain right handle bar 1002 and left rocker 1080 out of phase with respect to each other by 180 degrees. Separate adjustable resistance means may be connected to arm crank 1105 independent from any resistance means which may be connected to pedal crank 1000. FIG. 4 shows the position of pawl yoke 1020 associated with unison reciprocating action of the handle bars.

Figure 5A:
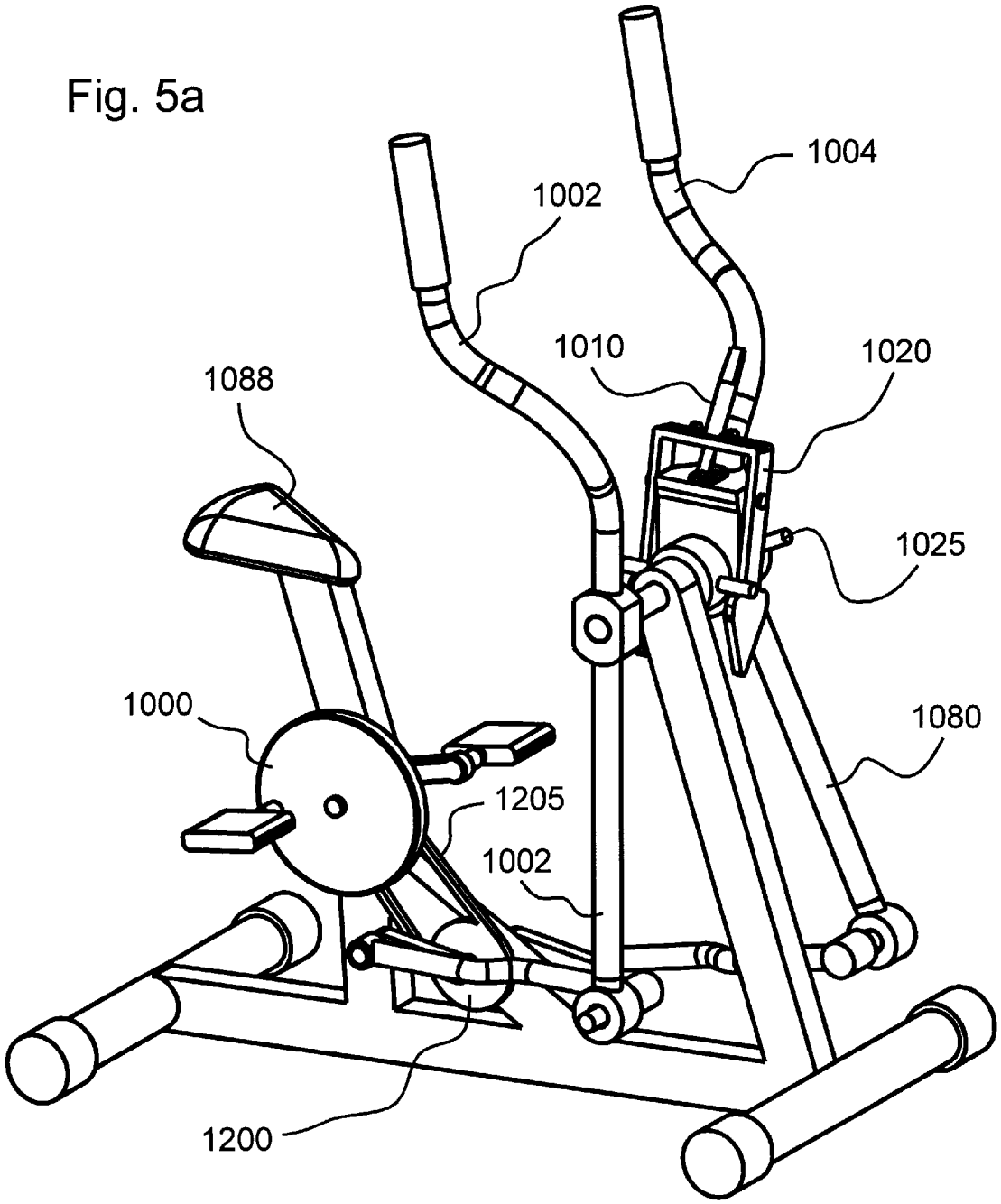
FIG. 5*a* is a perspective view of a third exercise apparatus constructed according to the principles of the present invention, with the arm members set to move back and forth together.
Figure 5B:
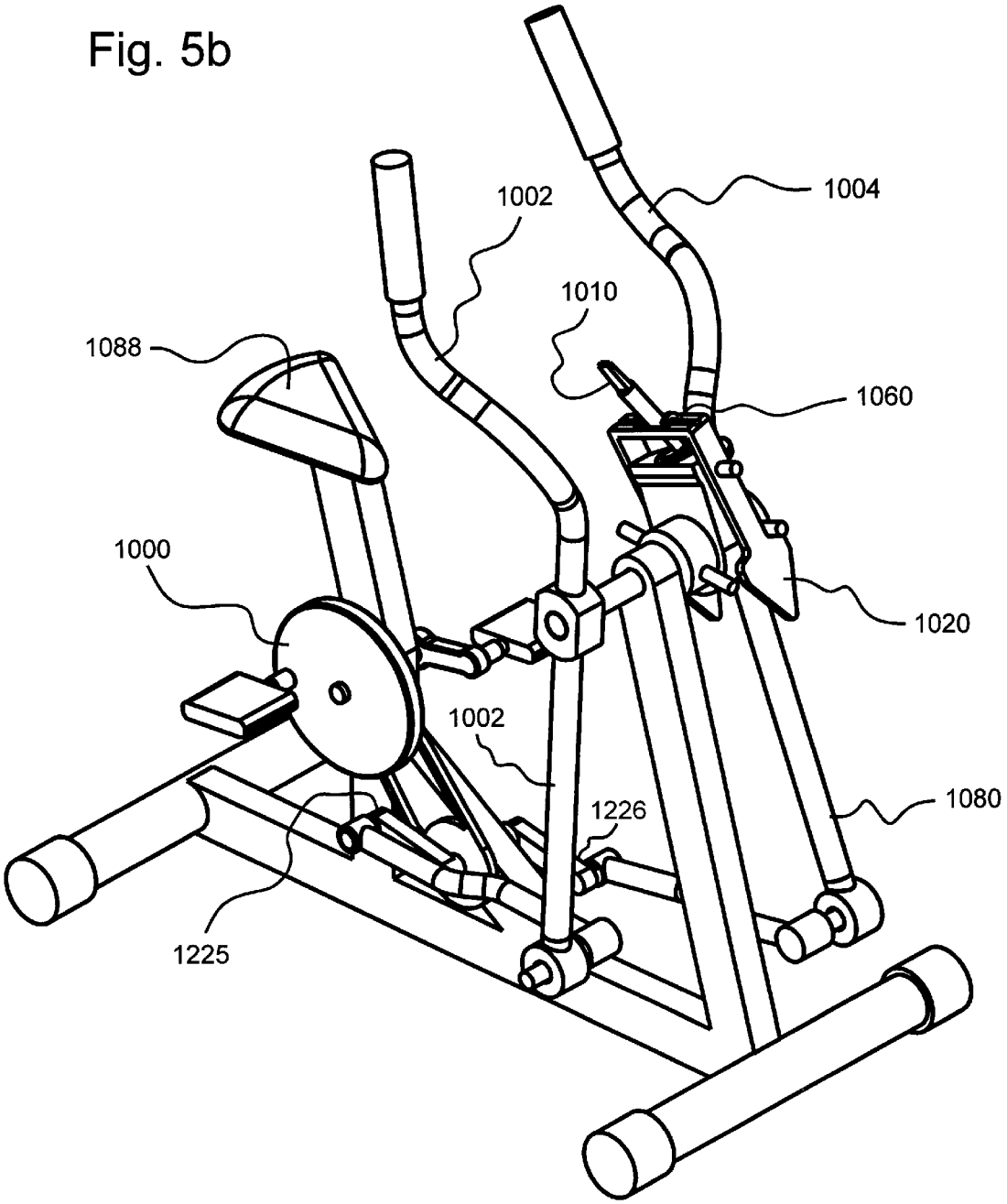
FIG. 5*b* is another perspective view of the exercise apparatus shown in FIG. 5*a*, with the arm members set to move back and forth in alternating fashion.

FIGS. 5*a* and 5*b* show the handle bars connected to a handle bar pulley crank 1200 via crank arms 1225 and 1226. Handle bar pulley crank 1200 is slightly larger in diameter than an unillustrated pedal crank pulley placed between the pedal crank 1000 and the machine frame. For example, if the handle bar pulley crank 1200 is driven with a bicycle style roller chain 1205, handle bar pulley crank 1200 may be a 33 tooth sprocket, and the pedal crank pulley may be a sprocket containing 32 teeth. One purpose for establishing a phase timing which is different between the foot pedals and the handle bars is to ensure that right and left muscles of the operator's body are exercised equally. Referring now the mode in which the handle bars are operating, FIG. 5*a* shows the shift peg 101 and the pawl yoke 1020 set for unison reciprocating motion of the hand grips. FIG. 5*b* shows the shift peg 1010 and the pawl yoke 1020 set for opposite reciprocating motion of the hand grips.

Figure 6:
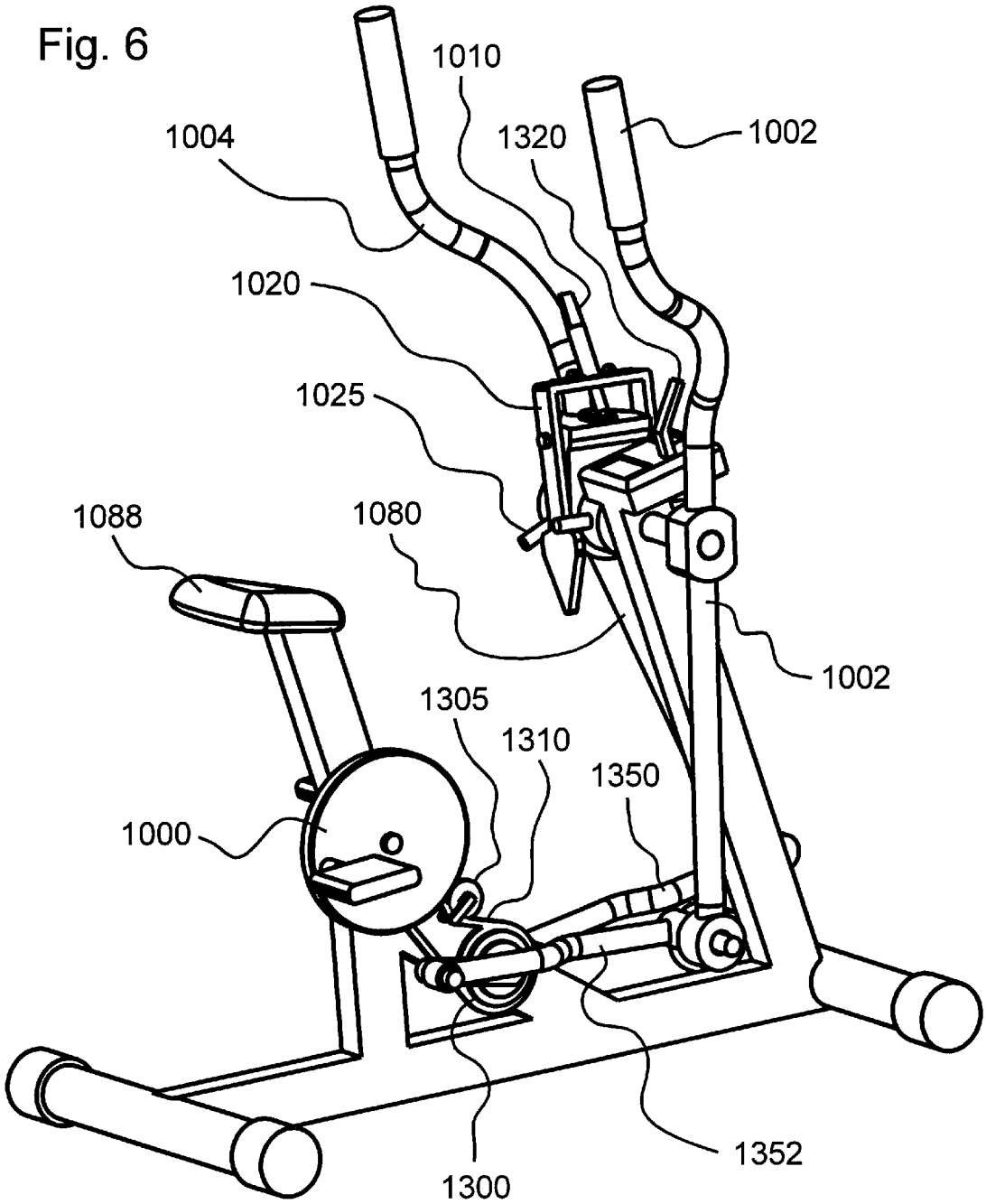
FIG. 6 is a perspective view of a fourth exercise apparatus constructed according to the principles of the present invention.

FIG. 6 shows an embodiment which is similar to FIGS. 5*a* and 5*b*, except that a multi-speed sprocket 1300 (having sprocket wheels of different sizes) is provided and functions in conjunction with derailleur 1305. The multi-speed sprocket 1305 will not only provide for a phase difference between the foot pedals and the handle bar, but will also enable the operator to adjust the ratio through a broad range of phase velocities. FIG. 6 illustrates the mechanism with the shift peg 1010 and the pawl yoke 1020 set for unison synchronous motion of the left and right handle bars 1004 and 1002.

Figure 7:
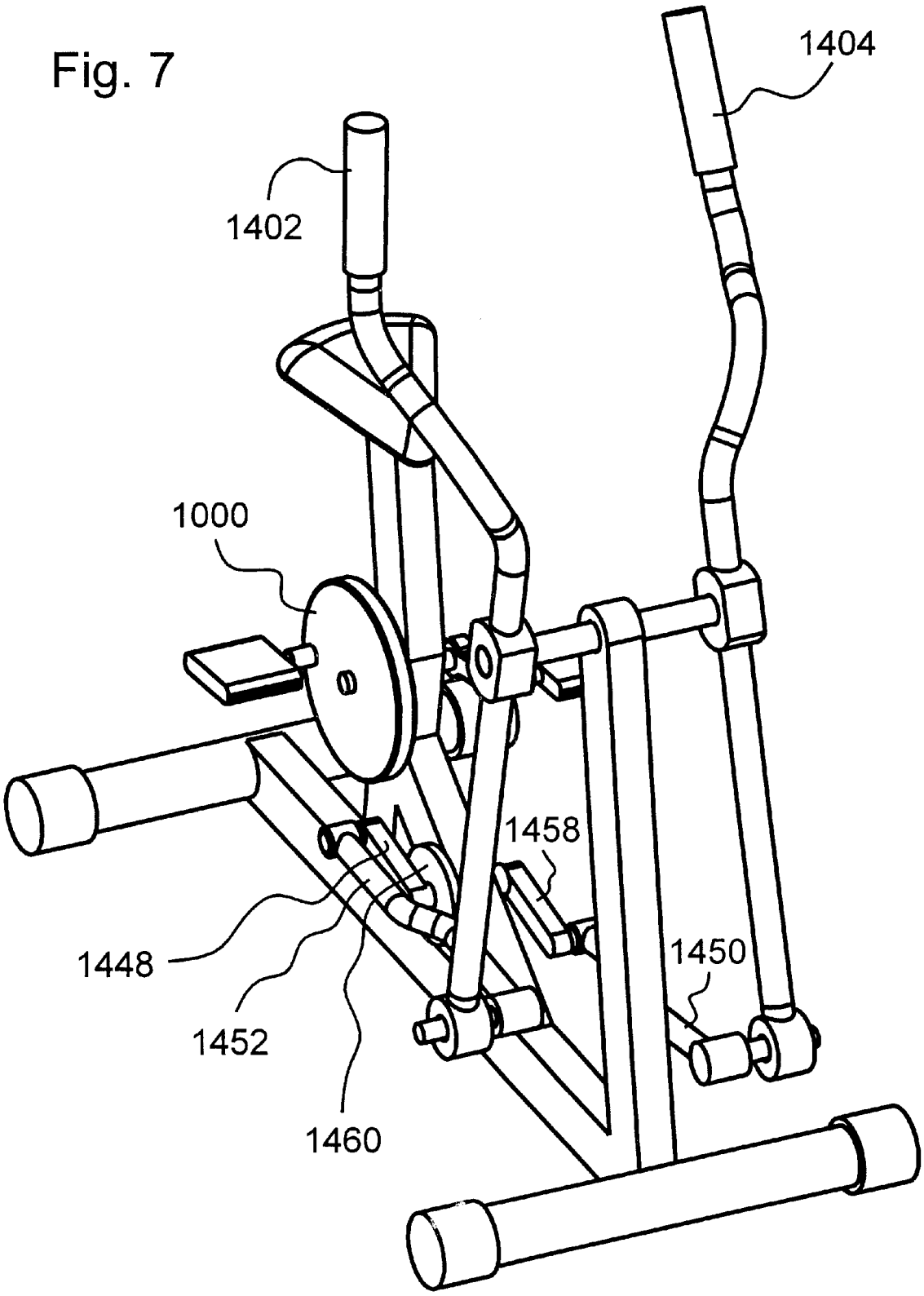
FIG. 7 is a perspective view of a fifth exercise apparatus constructed according to the principles of the present invention.

FIG. 7 shows an upright exercise bike without the bimodal handle bar mechanism of the previous embodiments. On this embodiment, opposite reciprocating action of the handle bars is provided independent of the motion of pedal crank 1000. Arm flywheel 1460 is rotatably connected to the machine frame, and is rigidly secured to right arm crank 1452 and left arm crank 1458. Right connector 1452 and left connector 1450 transmit timing and inertia between right and left handle bars 1402 and 1404 respectively. Resistance means may be added to arm flywheel 1460 independent of resistance means which may or may not be added to pedal crank 1000. In any event, additional flywheels may be included to supplement available inertia delivered to the operator's feet or arms.

Figures 8A, 8B:
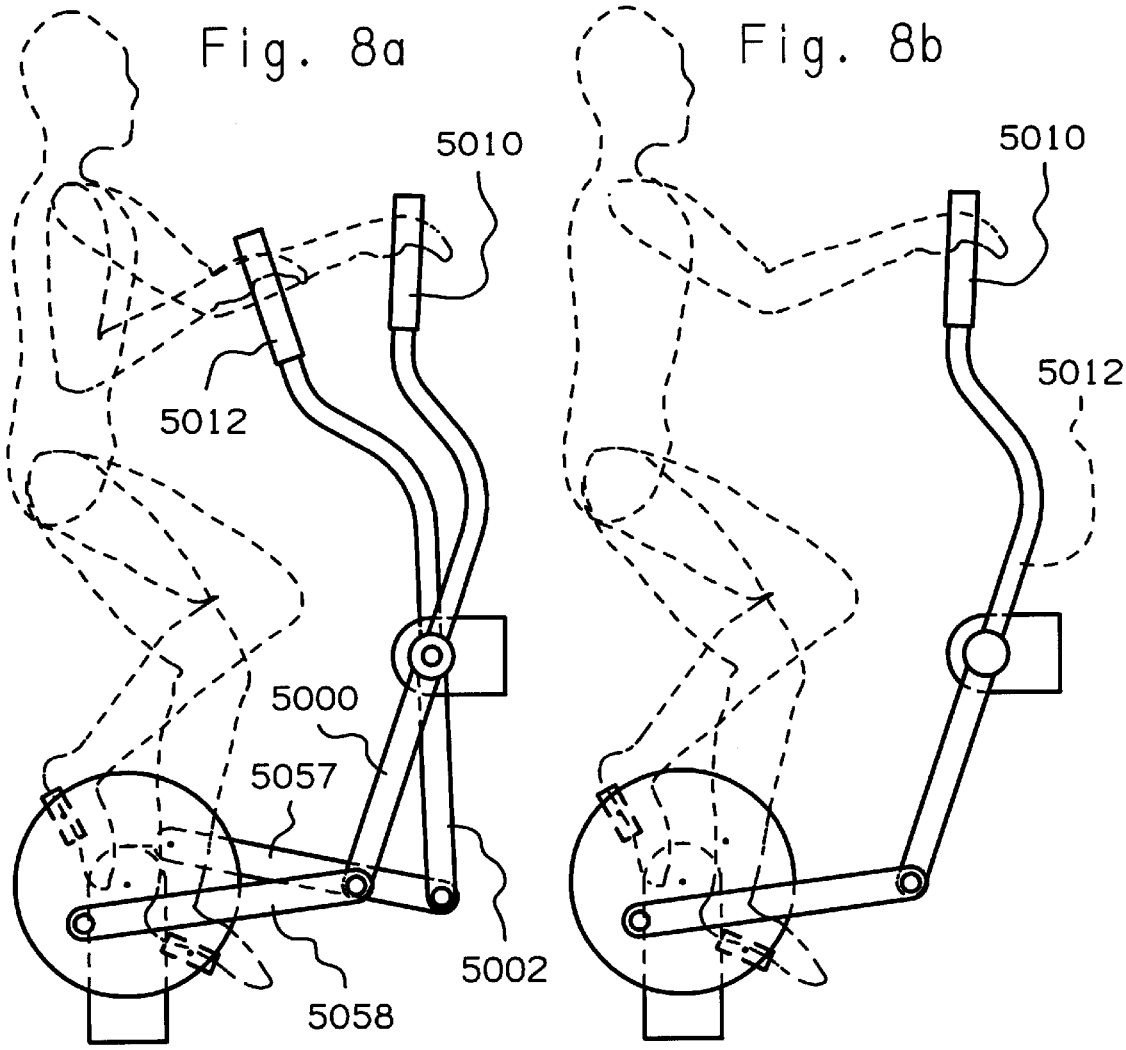
FIG. 8*a* is a side view of a sixth exercise apparatus constructed according to the principles of the present invention, with the arm members set to move back and forth in alternating fashion.
FIG. 8*b* is a side view of the exercise apparatus shown in FIG. 8*a*, with the arm members set to move back and forth together.
Figure 9A:
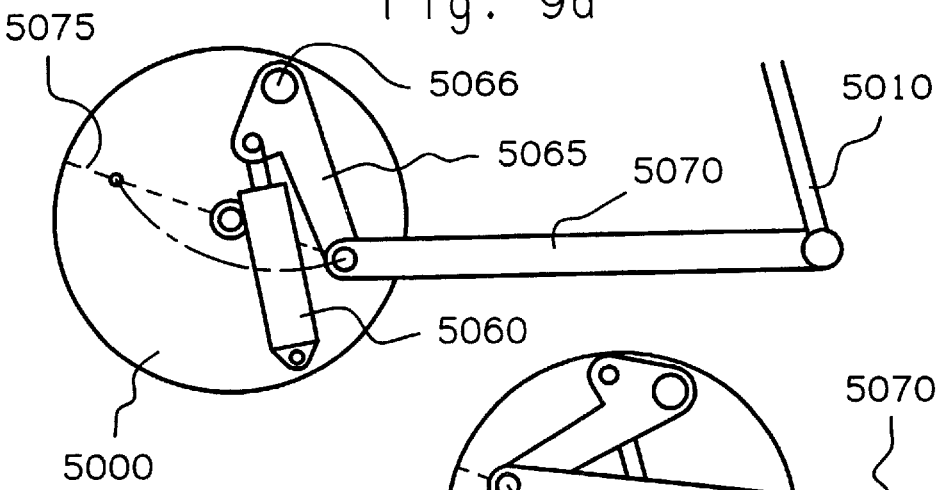
FIG. 9*a* is a side view of a first crank-mounted switching arrangement suitable for switching between the arm member motion associated with FIG. 8*a* and the arm member motion associated with FIG. 8*b*, with the arm members set to move back and forth in alternating fashion.
Figure 9B:
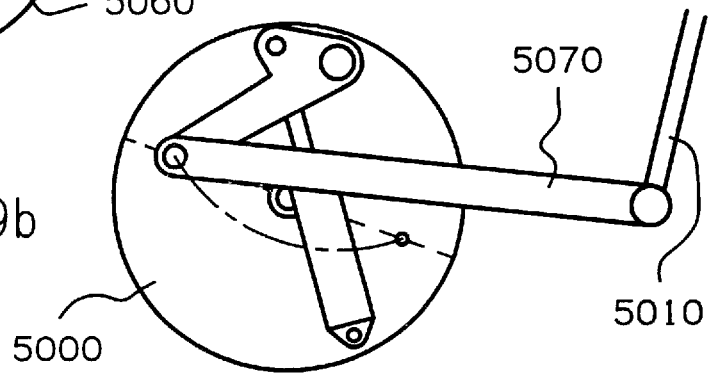
FIG. 9*b* is a side view of the switching arrangement shown in FIG. 9*a*, with the arm members set to move back and forth together.
Figure 10A:
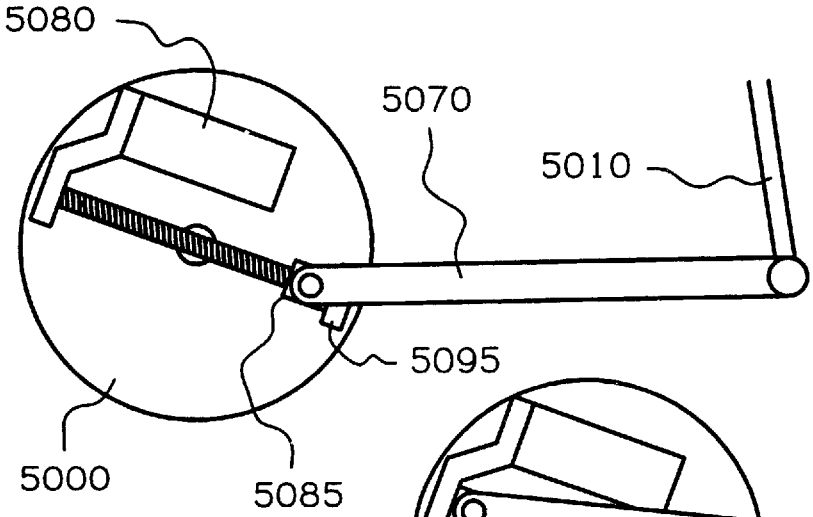
FIG. 10*a* is a side view of a second crank-mounted switching arrangement suitable for switching between the arm member motion associated with FIG. 8*a* and the arm member motion associated with FIG. 8*b*, with the arm members set to move back and forth in alternating fashion.
Figure 10B:
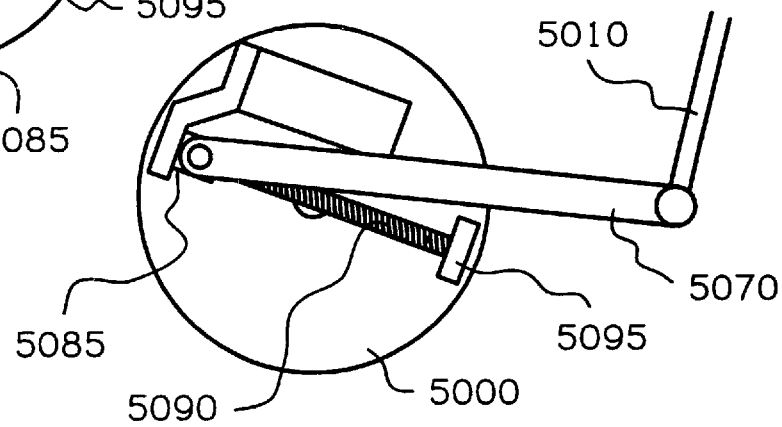
FIG. 10*b* is a side view of the switching arrangement shown in FIG. 10*a*, with the arm members set to move back and forth together.

FIGS. 8*a* and 8*b* show an upright exercise bike (seat not illustrated) wherein right and left handle bars 5010 and 5012 may be established to operate in unison or opposite reciprocating motion. Means may be provided whereby connector members 5057 and 5058 are rotatably connected at a common crank location for unison hand grip motion, or whereby connector members 5057 and 5058 are connected at the crank/flywheel 5050 in a diametrically opposed relationship for opposite reciprocating motion at the hand grips. Such means for example may include a crank pivot arm 5065 which may be moved from a first position shown in FIG. 9*a*, to a second position shown in FIG. 9*b*, by an electric actuator 5060 or functionally similar element. Alternatively, an electric motor 5080 shown in FIG. 10*a* and FIG. 10*b* may be employed to rotate a screw 5090 which is diametrically installed on crank 5000. Journal blocks 5085 may be moved from a first position to a second position, thereby changing hand grip modes from unison motion to opposite reciprocating motion. Screw 5090 is rotatably secured to each side of the crank (with the axis of the screw perpendicular to the axis of the crank) by bearings contained within journal block 5095 and electric motor assembly 5080.

Figure 11A:
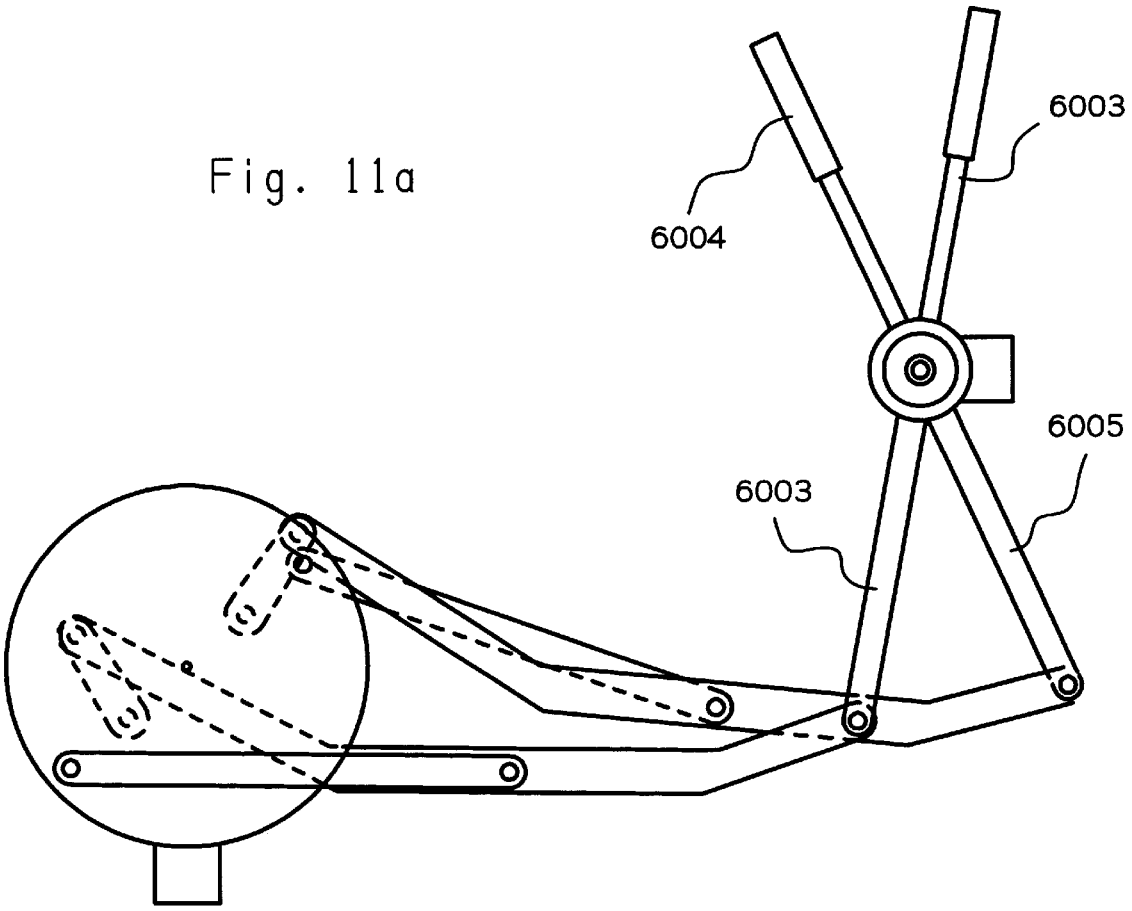
FIG. 11*a* is a side view of a seventh exercise apparatus constructed according to the principles of the present invention, with the arm members set to move back and forth in alternating fashion.
Figure 11B:
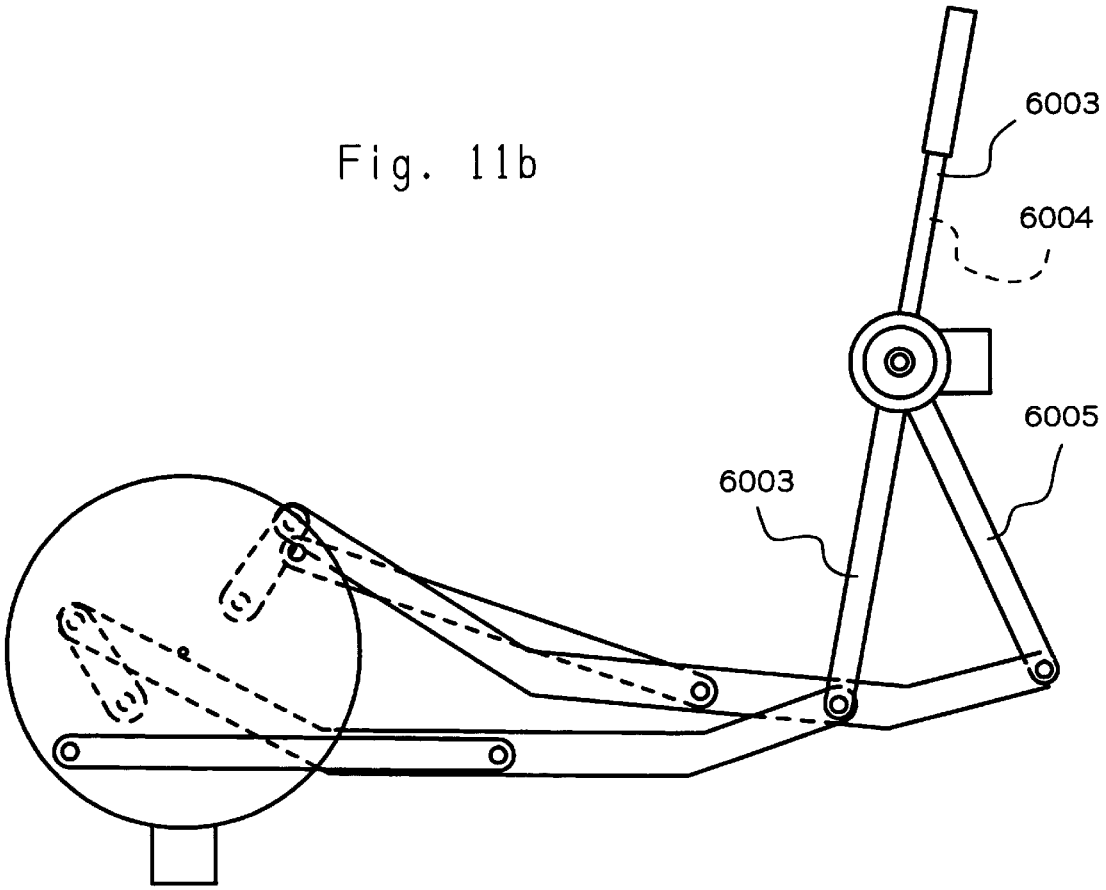
FIG. 11*b* is a side view of the exercise apparatus shown in FIG. 11*a*, with the arm members set to move back and forth together.

FIG. 11*a* and 11*b* show an elliptical striding machine having handle bars 6003 and 6004 which operate in opposite reciprocating manner (FIG. 11*a*), or in unison (FIG. 11*b*). Shift peg and pawl yoke (or functionally similar mechanism) are not illustrated.

Figure 12:
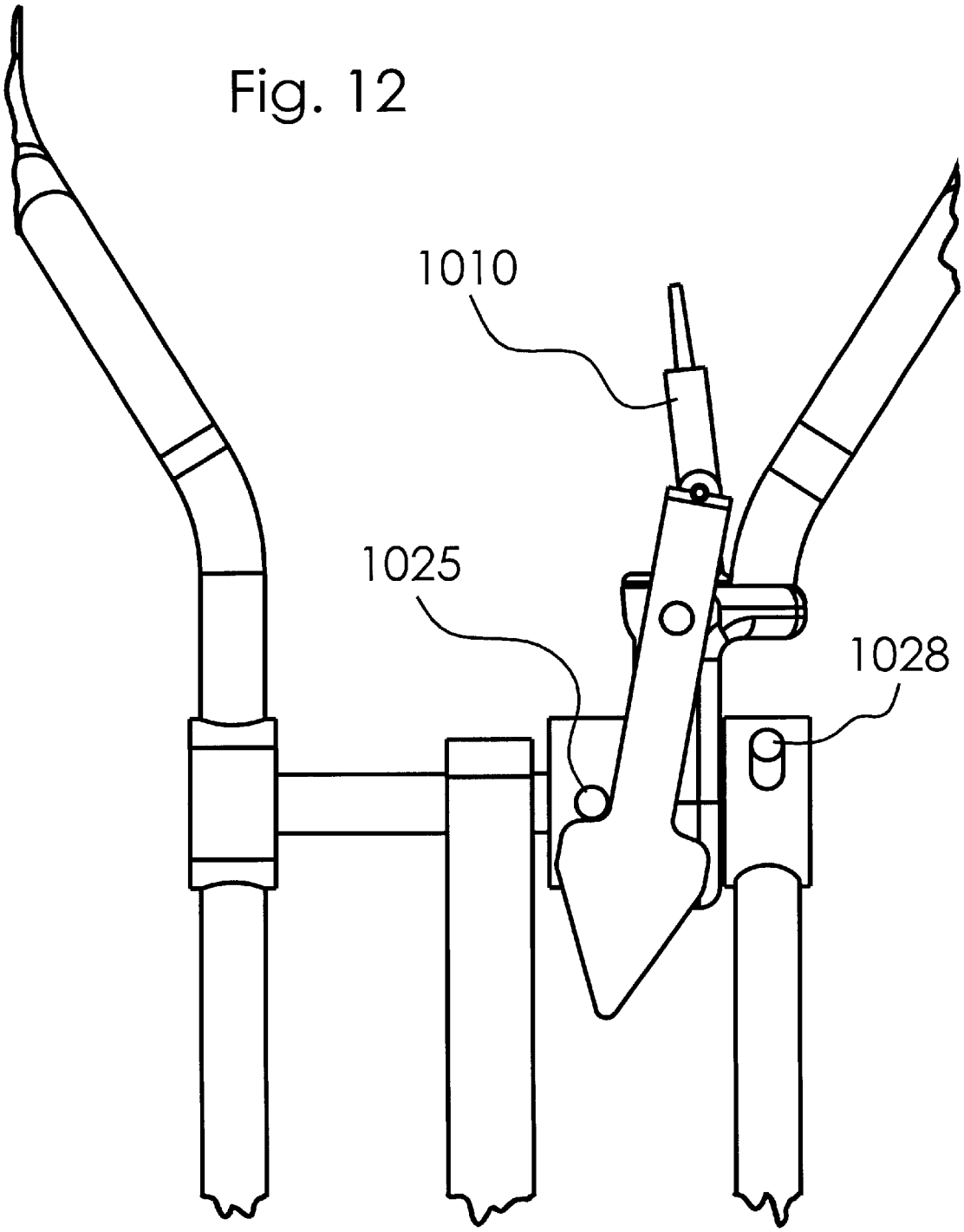
FIG. 12 is an enlarged and fragmentary rear view of the exercise apparatus shown in FIG. 1.
Figure 13:
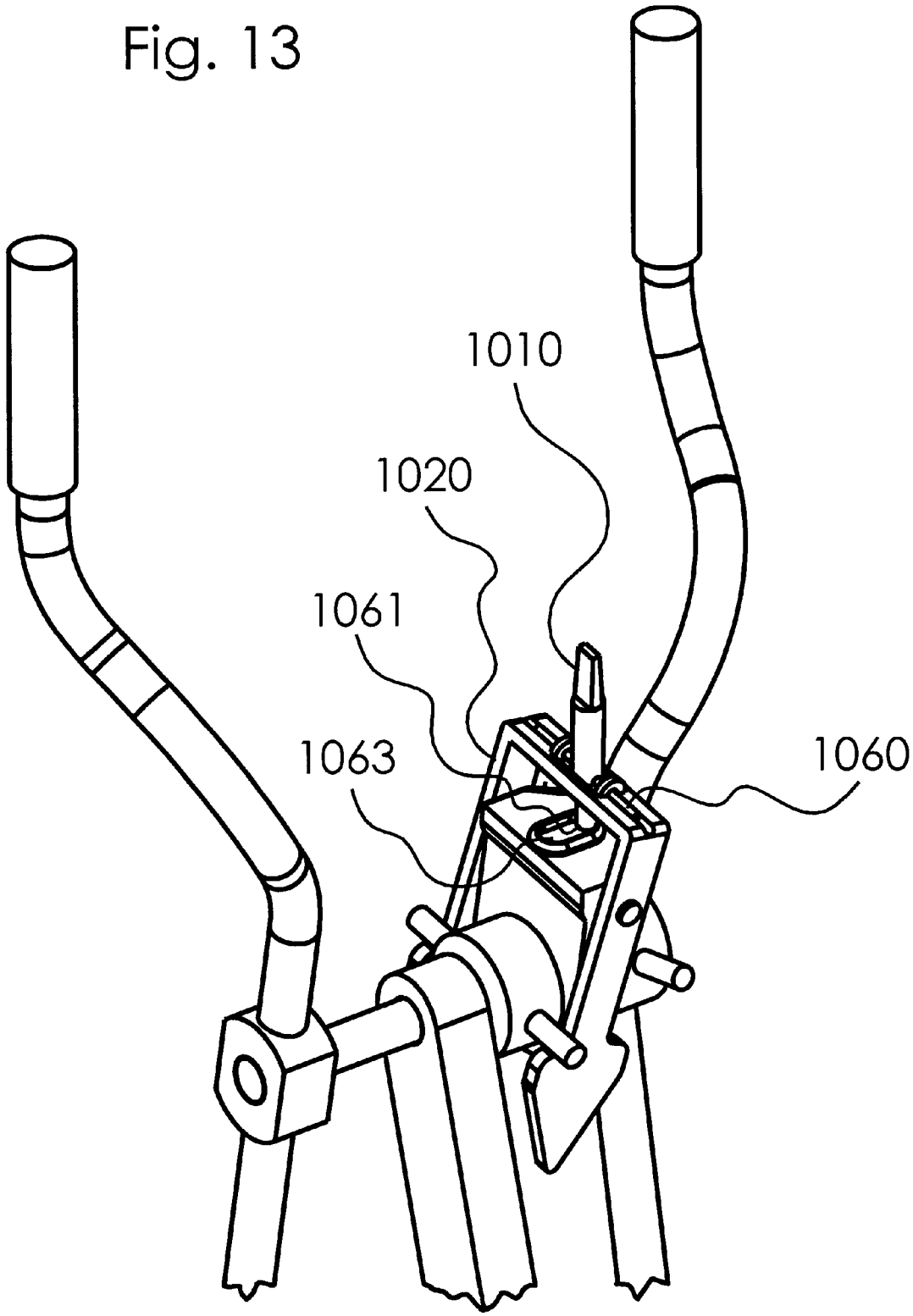
FIG. 13 is an enlarged perspective view of the arm switching arrangement on the exercise apparatus shown in FIG. 1.
Figure 14:
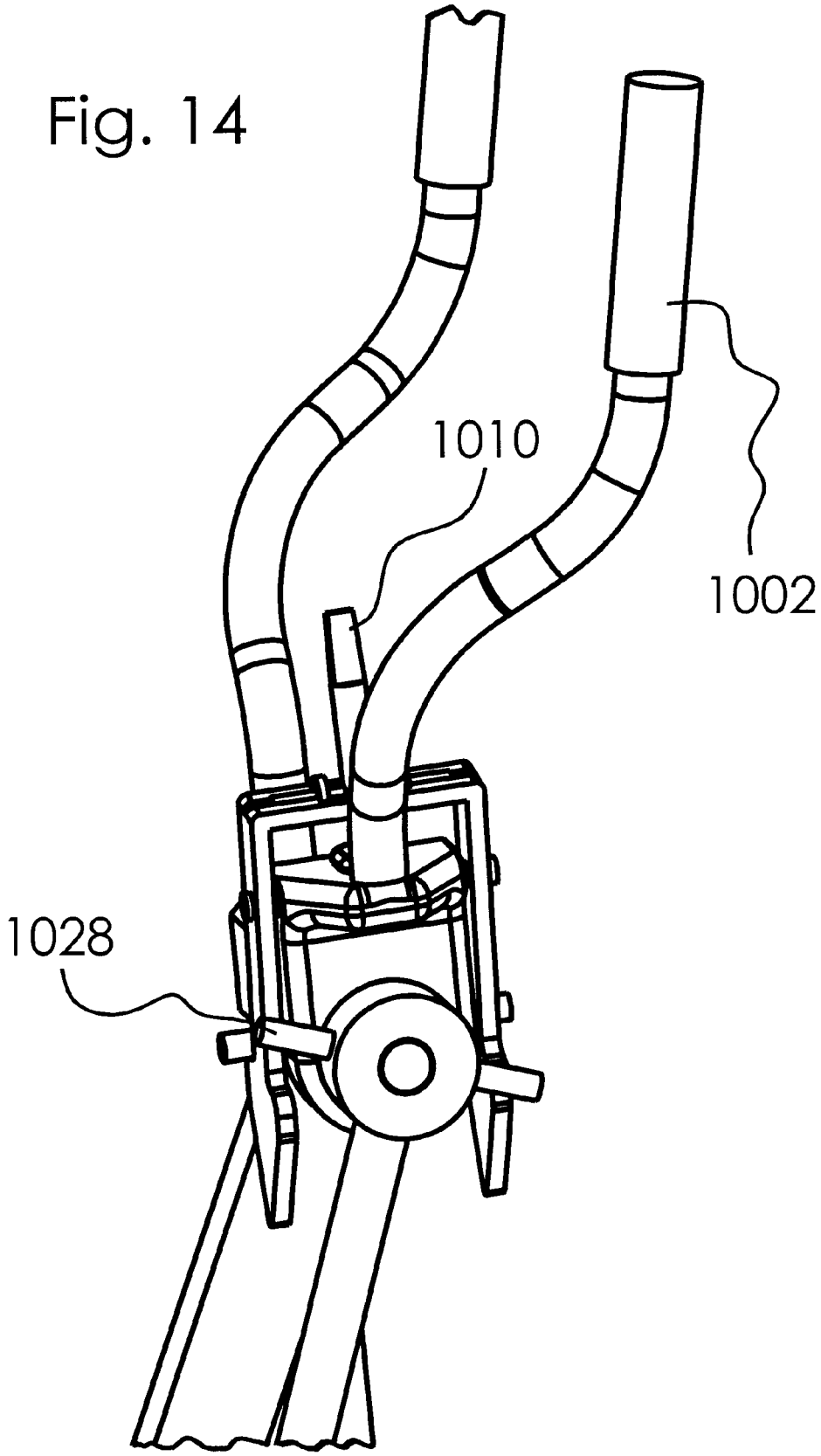
FIG. 14 another enlarged perspective view of the arm switching arrangement shown in FIG. 13.

FIGS. 12–13 show the adjustment arrangement of FIGS. 1–3 after the shift peg 1010 has been flipped, but while the pawl yoke 1020 has not yet reoriented, and FIG. 14 shows an additional perspective view of this arrangement.

Considering the different handle bar actions disclosed herein, the following handle bar modes may be incorporated on stationary cycles or stationary striders:

A. Handles locked to the frame (typically in a position aligned with each other).

B. Handles moving together, aligned, independent from the lower body with separately adjustable upper body resistance (or optional separate left/right resistance).

C. Handles moving opposed to each other, independent from the lower body with separately adjustable upper body resistance (like B except handles are not locked to each other to make them work in unison—they would basically be free to move independent of each other).

D. Handles moving together, linked to the lower body mechanism.

E. Handles moving together, linked to the lower body but with separate upper body resistance and/or variable hand grip stroke range mechanism.

F. Handles moving opposed to each other but linked to the lower body mechanism.

G. Handles moving opposed to each other, linked to the lower body mechanism, with separate resistance for the upper body and/or variable hand grip stroke range mechanism.

H. Handles that are linked to each other to make them reciprocate with each other but not linked to the lower body. For example, setting 1 could be right arm forward/right foot forward—setting 2 could be right arm forward/right foot rearward—setting 3 could be right arm forward/right foot mid position (90 degrees out of phase).

I. Same as H except with arms moving in unison.

J. Any of the above arrangements with the handles having lateral movement.

K. Any of the above arrangements with handles that have grasping portions that are movable further from or closer to the pivot. For example the upper ends of the handles could telescope, and you could have up and down movement, back and forth movement, and side to side movement.

L. Any of the above arrangements which include linking the upper body to the lower body with crank and arm sprockets of unequal diameter in order that phasing between the upper body and the lower body is always changing.

What is claimed is:

1. An exercise apparatus, comprising:

a frame designed to rest upon a floor surface; and a left arm driven member and a right arm driven member, wherein each said arm driven member is pivotally mounted on the frame, and an arm driven member interconnection linkage, wherein in a first mode of operation, the left arm driven member and the right arm driven member are constrained to move reciprocally in opposite directions relative to one another, and in a second mode of operation, the left arm driven member and the right arm driven member are constrained to move in the same direction relative to the frame.

2. The exercise apparatus of claim 1, further comprising a left leg driven member and a right leg driven member, wherein each said leg driven member is movably mounted on the frame.

3. The exercise apparatus of claim 2, wherein each said leg driven member is linked to a respective arm driven member.

4. A method of exercise, comprising the steps of:

providing a frame to rest upon a floor surface;

pivotally mounting left and right handles on the frame; and alternatively (a) constraining the handles to pivot in a like direction relative to the frame and pivoting the handles back and forth together relative to the frame, and (b) constraining the handles to pivot in opposite directions and pivoting the handles back and forth in opposite directions relative to one another.

5. The method of claim 4, further comprising the step of movably mounting left and right foot supports on the frame.

6. The method of claim 5, further comprising the steps of linking the foot supports to respective handles.

7. The method of claim 4, further comprising the step of mounting a seat on the frame.

* * * * *